US005603072A

United States Patent [19]

Kouno et al.

[11] Patent Number: 5,603,072

[45] Date of Patent: Feb. 11, 1997

[54] METHOD FOR PRODUCING FE-BASED SINTERED BODY WITH HIGH-CORROSION RESISTANCE

[75] Inventors: Tomio Kouno, Nagoya; Mitsuaki Asano, Toyota, both of Japan

[73] Assignee: Daido Tokushuko Kabushiki Kaisha, Nagoyo, Japan

[21] Appl. No.: 340,291

[22] Filed: Nov. 14, 1994

[30] Foreign Application Priority Data

Nov. 15, 1993 [JP] Japan ..... 5-309775

[51] Int. Cl.[6] ..... B22F 3/16

[52] U.S. Cl. ..... 419/25; 419/38; 419/56; 419/57; 75/228; 75/243; 75/246

[58] Field of Search ..... 75/228, 243, 246, 75/255; 419/25, 38, 56, 57, 58

[56] References Cited

U.S. PATENT DOCUMENTS

| | | | |
|---|---|---|---|
| 3,620,690 | 11/1971 | Bergstrom | 29/182 |
| 3,993,445 | 11/1976 | Reen | 29/182.5 |
| 4,014,680 | 5/1977 | Reen | 75/0.5 BA |
| 4,028,094 | 6/1977 | Reen et al. | 75/0.5 BA |
| 4,340,432 | 7/1982 | Hede | 148/11.5 |
| 4,420,336 | 12/1983 | Klar et al. | 75/246 |
| 4,614,638 | 9/1986 | Kuroishi et al. | 419/39 |
| 4,964,908 | 10/1990 | Greekham | 75/241 |
| 4,964,909 | 10/1990 | Engstrom et al. | 75/246 |
| 5,108,492 | 4/1992 | Kiyota et al. | 75/246 |
| 5,338,508 | 8/1994 | Nitta et al. | 420/120 |

*Primary Examiner*—Charles T. Jordan
*Assistant Examiner*—Chrisman D. Carroll
*Attorney, Agent, or Firm*—Sughrue, Mion, Zinn, Macpeak & Seas

[57] ABSTRACT

Fe-based alloy powder suitable for manufacturing sintered products with excellent corrosion resistance for example, which comprises by weight percentage of not more than 0.03% of C; not more than 2% of Si; not more than 0.5% of Mn; from 8 to 28% of Ni; from 15 to 25% of Cr; from 3 to 8% of Mo; optionally at least one of not more than 5% of Cu; not more than 3 % of Sn; not more than 2% of Nb and not more than 2% of Ti; and the balance being Fe and incidental impurities. The Fe-based alloy powder is sintered in an inert gas such as Ar or $H_2$, or in an atmosphere of $N_2$ with pressure of 1 to 10 torr after being compacted. A sintered compact sintered in an atmosphere of $N_2$ with pressure of higher than 10 torr and not higher than 200 torr is cooled at cooling rate of higher than 50° C./min.

4 Claims, No Drawings

METHOD FOR PRODUCING FE-BASED SINTERED BODY WITH HIGH-CORROSION RESISTANCE

BACKGROUND OF THE INVENTION

1. Field of the Invention

This invention relates to Fe-based alloy powder, an Fe-based sintered body with high-corrosion resistance and a method for producing the Fe-based sintered body with high-corrosion resistance by using the aforementioned Fe-based alloy powder.

2. Description of the Prior Art

A powder metallurgical method, that is a process consisting in compacting metal powder (inclusive alloy powder) into a desired shape and sintering the obtained compact has been widely utilized as one of manufacturing methods for metallic products.

Generally, in a case of manufacturing metallic products required for high corrosion resistance, metal powder excellent in the corrosion resistance, such as stainless steel powder is used. However, there is a characteristic and difficult problem in the powder-sintered body as compared with metallic products made from ingot steel.

Namely, in the case of the powder-sintered body, there is the problem in that open pores remain in the sintered body (product), and rust is apt to start and proceed from the open pores. Namely, a difference arises in oxygen concentration between inside and outside of the open pore, and crevice corrosion develops owing to the the difference in the oxygen concentration.

Accordingly, the products manufactured through the powder-sintering process is inferior to the metallic products made from the ingot steel in the corrosion resistance in any rate.

DESCRIPTION OF THE INVENTION

This invention is made for the purpose of solving the aforementioned problem of the prior art.

The Fe-based alloy powder according to this invention is, for example, suitable for manufacturing the sintered products with high-corrosion resistance, and characterised by comprising by weight percentage of not more than 0.03% of C; not more than 2% of Si; not more than 0.5% of Mn; from 8 to 28% of Ni; from 15 to 25% of Cr; from 3 to 8% of Mo; optionally at least one of not more than 5% of Cu; not more than 3% of Sn; not more than 2% of Nb and not more than 2% of Ti; and the balance being Fe and incidental impurities, wherein the powder consists of homogenous metal powder or a mixture of heterogeneous metal powders.

The sintered body with high corrosion-resistance according to this invention is characterized by being made from the Fe-based alloy powder defined in claim 1 and controlling the nitrogen content to less than 0.5%.

The method for producing a high corrosion-resisting sintered body according to an aspect of this invention is characterized by comprising the steps of compacting the Fe-based alloy powder defined in claim 1 to form green compact and sintering the green compact in an inert gas such as Ar or $H_2$, excepting $N_2$.

The method for producing a high corrosion-resisting sintered body according to another aspect of this invention is characterized by comprising the steps of compacting the Fe-based alloy powder defined in claim 1 to form green compact and sintering the green compact in an atmosphere of $N_2$ with pressure of 1 to 10 torr.

The method for producing a high corrosion-resisting sintered body according to the other aspect of this invention is characterized by comprising the steps of compacting the Fe-based alloy powder defined in claim 1 to form green compact, sintering the green compact in an atmosphere of $N_2$ with pressure of higher than 10 torr and not higher than 200 torr, and cooling the sintered compact from 1000° C. to 500° C. at cooling rate of not lower than 50° C./min.

When the Fe-based alloy powder is prepared according to the aforementioned chemical composition defined in claim 1 of this invention and the sintered body is manufactured using such the alloy powder under the specified sintering condition, it is possible to obtain the sintered body excellent in the corrosion resistance.

The Fe-based alloy powder according to this invention may be composed of metal powder particles of the same kind or composed of the mixture of metal powder particles of a different kind. In other words, it is possible to prepare the alloy powder according to this invention by melting an alloy having the chemical composition defined in claim 1 and making the alloy powder from the molten alloy, or also possible to obtain the alloy powder by mixing powder particles of a different kind so as to harmonize a chemical composition of the mixture with the chemical composition defined in claim 1 as a whole.

When the powder consisting of the heterogenous powder particles is heated by, for example, sintering, alloying of the powder proceeds and an alloy having desired chemical composition is obtained finally.

It is possible to supply the Fe-based alloy powder according to this invention for various purposes, as powder for the powder metallurgy, for sintered filters, for the injection molding, for the thermal spraying and the like.

By the way, the alloy powder with a particle size not larger than 150 μm manufactured through the water atomization process is used generally for the powder metallurgical purpose.

In corrosive environment in a level of the air or the relatively clean water, the sintered body made from the Fe-based alloy powder according to this invention is used without any serious problem. However, in the high corrosive environment in pitting and crevice corrosiveness containing especially chloride ions in large quantities, it is preferable to avoid formation of pores with a diameter having a tendency to generate the crevice corrosion (the crevice corrosion is apt to develop in the sintered body with density ratio of 85 to 90%).

In the case of using the alloy powder for the sintered filters, the alloy powder with a particle size of 60 to 350 μm manufactured through the water on gas atomization process is generally used, and so sintered that the density ratio of the resulting sintered body may be 30 to 70%.

In the further case of using the alloy powder for the injection molding, usually the water-atomized powder with a particle size not larger than 50 μm or the gas-atomized powder with a particle size not larger than 100 μm of which tap density is not lower than 3 g/cm$^3$ is used.

As an alloy powder for the thermal spraying, generally the water-atomized powder with a particle size not larger than 50 μm or the gas-atomized powder with a particle size not larger than 150 μm of which flow rate is not longer than 20 sec/50 g is used.

In the Fe-based alloy powder according to this invention, it is possible to optionally include at least one of Cu, Su, Nb and Ti in the predetermined quantities, and possible to further improve the corrosion resistance by addition of these optional elements.

Next, the reason why the chemical composition of the Fe-based alloy powder according to this invention is limited to the above-mentioned ranges will be described below.

C: not more than 0.03%

Although carbon is added as a deoxidizer in the steel making process, the corrosion resistance is extremely harmed when the residual carbon in the alloy powder exceeds 0.03% by weight percentage, so that the upper limit of carbon is defined to 0.03%.

Si: not more than 2%

Silicon is added in the steel making process as a deoxidizer, but increases a hardness of the alloy powder and harms formability in the case of compacting the alloy powder by remaining excessively in the alloy powder. Therefore, the upper limit of silicon is defined to 2% by weight in this invention.

Mn: not more than 0.5%

Although manganese is added as a deoxidizer and a desulfurizer in the steel making process, increases solubility of N at the sintering process, stimulates precipitation of Cr-nitride at the cooling process and deteriorates the corrosion resistance of the sintered body by excessively remaining in the alloy powder. Furthermore, manganese increase oxygen content in the alloy powder, deteriorates cleanliness of the sintered body and forms non-metallic inclusions from which the corrosion starts, and harms the corrosion resistance of the sintered body. Therefore, the upper limit of manganese is defined to 0.5% in this invention.

Ni: 8 to 28%

Nickel is effective for stabilizing the austenire phase and improving the corrosion resistance (especially in anti-oxidative acid), and required to be added in an amount of not less than 8% by weight. However, the effect of manganese is saturated even if manganese is added more than 28% by weight.

Cr: 15 to 25%

Chromium has remarkably high ability to form a passive state, is a fundamental element for improving the corrosion resistance and required to be added in an amount of not less than 12% ordinarily. However, it is necessary to be added in the amount of not less than 15% of chromium in order to reinforce the passive film to be formed on a surface of the sintered body in the powder-sintered products, since the sintered body has relatively wide surface area and is inferior to metallic products made from the ingot steel in the corrosion resistance. But it is not possible to obtain the remarkable effect for improving the corrosion resistance even if chromium is added more than 25% by weight.

Mo: 3 to 8%

Molybdenum is effective stimulate the formation of the passivity and improve the acid resistance, and it is necessary to be added in an amount of not less than 3% by the same reason as that described as to chromium. However, it is not possible to obtain the remarkable effect for improving the corrosion resistance even if molybdenum is added more than 8% by weight.

Cu: not more than 5%

Copper is effective for improving the acid resistance (especially sulfate resistance) by making a matrix of the sintered body noble. However, the effect of copper is saturated even if copper is added more than 5% by weight.

Sn: not more than 3%

Tin improves the acid resistance by making the matrix of the sintered body noble. However, the effect is saturated even if tin is added more than 3% by weight.

Nb: not more 2%

Niobium is effective for preventing the sintered body from intergranular corrosion by immobilizing carbon and nitrogen in the sintered body. However, the effect of niobium is saturated even if niobium is added more than 2% by weight.

Ti: not more 2%

Titanium is effective to prevent the sintered body from the intergranular corrosion by immobilizing carbon and nitrogen in the sintered body. However, the effect of titanium is saturated even if titanium is added more than 2% by weight.

In the Fe-based alloy powder according to this invention, it is possible to obtain the alloy powder with nitrogen of the order of 0.003% by melting through the well-known melting process such as vacuum melting for example, therefore, the corrosion resistance of the sintered body is not substantially affected by nitrogen contained in the alloy powder.

The sintered body with high corrosion-resistance according to this invention is obtained by using the aforementioned alloy powder and controlling nitrogen content in the sintered body to less than 0.5% through the method according to this invention.

The nitrogen content in the sintered body originates mainly from $N_2$ in a sintering atmosphere, however the nitrogen can be dissolved in the sintered body merely in some degree. If the nitrogen content in the sintered compact (sintered body) becomes not less than 0.5%, the nitrogen is separated from the sintered compact and reacts with chromium in the sintered compact in the sintering and the cooling processes, so that the effective chromium concentration in the sintered body is reduced and the corrosion resistance of the sintered body is degraded. Therefore it is necessary at least to limit the nitrogen content in the sintered body to less than 0.5% for maintaining the corrosion resistance of the sintered body in a high level.

In the method defined in claim 3 according to this invention, the high corrosion-resisting sintered body is obtained by compacting the aforementioned Fe-based alloy powder to form green compact and sintering the green compact in an inert gas such as a Ar or $H_2$, excepting $N_2$.

In the sintered products, it is considered that properties of the products depend on the sintering condition. Therefore, as a result of investigating the effect of the sintering condition on the corrosion resistance of the sintered body, a following fact was confirmed by the inventors.

Namely, stainless steel powder of SUS 316L (corresponding to 19, 19*a* specified in ISO) was compacted to form green compact having a desired shape, subsequently the green compact was sintered in a vacuum. Then it was confirmed that the obtained sintered body was easy to be corroded by putting the sintered body to a corrosion test (salt spray test for 96 hours).

As the reason, it is considered that chromium in the sintered body disperses and is lost from the surface of the sintered body by sintering the stainless steel powder (green compact) of SUS 316L in a vacuum. That is, according to the investigation of the chromium concentration on the cross section in the vicinity of the surface of the vacuum-sintered body, the chromium concentration was remarkably reduced even to the half level of the chromium concentration at the inner part of the sintered body.

In other words, the surface of the sintered body made from the SUS 316L stainless steel powder is inferior to that of a metallic product made from the ingot stainless steel of SUS 316L from a view point of the chemical composition, and this is considered to be the main factor of degradation of the corrosion resistance.

Therefore, the inventors confirmed that it is possible to inhibit the chromium loss caused by dispersion from the surface of the sintered body by sintering the green compact in an inert gas such as Ar of $H_2$. This invention is made on basis of information of this kind, it is possible to maintain the chromium concentration at the surface of the sintered body on a high level and possible to improve the corrosion resistance of the sintered body according to this invention.

It is also possible to sinter the alloy powder (green compact) in an atmosphere of $N_2$ as recited in claim 4 and claim 5 of this invention. However, in such a case, it is necessary to perform the sintering in $N_2$ with pressure of 1 to 10 torr, or necessary to cool the sintered compact from 1000° C. to 500° C. at cooling rate of not lower than 50° C./min. after sintering the green compact in $N_2$ with pressure of higher than 10 torr and not higher than 200 torr. The reason will be described below in detail.

As chromium was lost from the surface of the sintered body by sintering in a vacuum, the inventors tried to sinter the green compact in an atmosphere of $N_2$ and put the sintered body to the corrosion test. As the result, it became clear that the corrosion resistance of the sintered body sintered in the atmosphere of $N_2$ depended on pressure of $N_2$.

For example, the nitrogen content in the sintered body was controlled in a low level and an excellent corrosion resistance was obtained when the sintering was carried out in the atmosphere of $N_2$ with pressure of 1 to 10 torr.

However, it was found that the corrosion resistance of the sintered body deteriorated when the sintering was performed in the atmosphere of $N_2$ with the pressure of higher than 10 torr and not higher than 200 torr and the sintered compact was cooled at an ordinary cooling rate.

Furthermore, it was also confirmed that the corrosion resistance of the sintered body was maintained on a favorable level if the sintering was performed in the atmosphere of $N_2$ with pressure of higher than 10 torr and not higher than 200 torr and the sintered compact was cooled at a high cooling rate of not lower than 50° C./min.

It seems to be caused by following reason.

Namely, when the alloy powder (green compact) is sintered in an atmosphere of $N_2$, nitrogen is dissolved in the matrix of the sintered compact, and the dissolved nitrogen is separated from the sintered compact and reacts with chromium in the sintered compact to form chromium nitrides during the cooling process from 1000° C. to 500° C.

In a case where the nitrogen pressure of the sintering atmosphere is in a range of 1 to 10 torr, the chromium nitrides are scarcely formed in the cooling process since the nitrogen is merely dissolved in a small quantity, so that the effective chromium concentration in the sintered compact is maintained in a high level and the corrosion resistance of the sintered body is not degraded substantially.

In a case where the nitrogen pressure of the sintering atmosphere is higher than 10 torr and not higher than 200 torr and the sintered compact is cooled at an ordinary low cooling rate, the nitrogen dissolved in the sintering process and separated from the sintered compact in the cooling process reacts with the chromium in the sintered compact, thereby forming the chromium nitrides. Therefore, the substantial chromium concentration is decreased owing to the formation of the chromium nitrides and the corrosion resistance of the sintered body detriorates. Even in such the case, it is possible to maintain the nitrogen in the dissolved state down to a room temperature by cooling the sintered compact at high cooling rate of not lower than 50° C./min. so as not to separate the nitrogen from the sintered compact, whereby the chromium nitrides are not formed and the corrosion resistance of the sintered body is not degraded.

However, when the green compact is sintered in the atmosphere of $N_2$ with pressure of higher than 200 torr, the nitrogen impossible to be dissolved in the sintered compact reacts with the chromium in the sintered compact in the sintering process, so that the nitrogen content in the sintered compact becomes 0.5% or more and it is not possible to prevent the formation of the chromium nitrides even if the sintered compact is cooled at the high cooling rate. Accordingly, the effective chromium concentration in the sintered body is decreased and the corrosion resistance of the sintered body deteriorates.

Additionally, when the sintering is carried out in the atmosphere of $N_2$ with the pressure of lower than 1 torr, chromium is lost by dispersing from the surface of the sintered compact, thereby deteriorating the corrosion resistance of the sintered body as described above.

DESCRIPTION OF THE PREFERRED EMBODIMENT

This invention will be described below in detail with reference to an example.

Alloy powders (water-atomized powder with particle size smaller than 100 mesh: approximately 150 μm) having chemical compositions shown in Table 1 were prepared. Each of alloy powders was compacted to form green compact under the pressing condition of 5 t/cm$^2$.

TABLE 1

| | Main Elements | C | Si | Mn | Ni | Cr | Mo | Cu | Sn | Nb | Ti | Remarks |
|---|---|---|---|---|---|---|---|---|---|---|---|---|
| 1 | 14Cr—5Ni—5Mo | 0.016 | 0.82 | 0.18 | 25.01 | 13.90 | 5.03 | | | | | Comparative |
| 2 | 14.5Cr—25Ni—2Mo | 0.015 | 0.86 | 0.28 | 24.96 | 14.51 | 2.00 | | | | | Example |
| 3 | 15.5Cr—20Ni—2Mo | 0.017 | 1.00 | 0.22 | 19.95 | 15.51 | 1.97 | | | | | |
| 4 | 16.5Cr—20Ni—2.5Mo | 0.014 | 0.93 | 0.24 | 20.00 | 16.40 | 2.53 | | | | | |
| 5 | 17Cr—7.5Ni—4Mo | 0.016 | 0.82 | 0.25 | 7.42 | 17.32 | 3.97 | | | | | |
| 6 | 16Cr—16Ni—5Mo | 0.017 | 0.80 | 0.08 | 16.02 | 15.89 | 5.05 | | | | | Inventive |
| 7 | | 0.017 | 0.80 | 0.08 | 16.02 | 15.89 | 5.05 | | | | | Example |
| 8 | | 0.017 | 0.80 | 0.08 | 16.02 | 15.89 | 5.05 | | | | | |
| 9 | | 0.017 | 0.80 | 0.08 | 16.02 | 15.89 | 5.05 | | | | | |
| 10 | 16Cr—13Ni—5Mo | 0.019 | 0.85 | 0.15 | 12.99 | 16.28 | 5.02 | | | | | |
| 11 | | 0.019 | 0.85 | 0.62 | 12.99 | 16.28 | 5.02 | | | | | Comparative Example |
| 12 | | 0.019 | 0.85 | 0.15 | 12.99 | 16.28 | 5.02 | | | | | Inventive |
| 13 | | 0.019 | 0.85 | 0.15 | 12.99 | 16.28 | 5.02 | | | | | Example |
| 14 | 19Cr—16Ni—4Mo | 0.018 | 0.79 | 0.23 | 16.03 | 19.00 | 3.96 | | | | | |

TABLE 1-continued

| Main Elements | C | Si | Mn | Ni | Cr | Mo | Cu | Sn | Nb | Ti | Remarks |
|---|---|---|---|---|---|---|---|---|---|---|---|
| 15 | 0.018 | 0.79 | 0.81 | 16.03 | 19.00 | 3.96 | | | | | Comparative Example |
| 16 | 0.018 | 0.79 | 0.23 | 16.03 | 19.00 | 3.96 | | | | | Inventive Example |
| 17 | 0.018 | 0.79 | 0.23 | 16.03 | 19.00 | 3.96 | | | | | |
| 18 | 0.018 | 0.79 | 0.23 | 16.03 | 19.00 | 3.96 | 4.99 | | | | |
| 19 | 0.018 | 0.79 | 0.23 | 16.03 | 19.00 | 3.96 | | 2.97 | | | |
| 20 | 0.018 | 0.79 | 0.23 | 16.03 | 19.00 | 3.96 | | | 1.99 | | |
| 21 | 0.018 | 0.79 | 0.23 | 16.03 | 19.00 | 3.96 | | | | 1.98 | |
| 22 | 0.018 | 0.79 | 0.23 | 16.03 | 19.00 | 3.96 | | | | | |
| 23 | 0.018 | 0.79 | 0.23 | 16.03 | 19.00 | 3.96 | | | | | |

Subsequently, the green compact was subjected to degreasing under the condition of 500° C.×1 hour, and then each of green compact was sintered under the respective condition as shown in Table 2.

Each of obtained sintered bodies were put to the salt spraying test using a solution of 5% NaCl according to JIS Z 2371 (Methods of Neutral Salt Spray Testing), and the formation of rust was observed. The results are shown in Table 2 together with the sintering conditions.

Although the embodiment according to this invention has been described, this is merely an example and this invention can be performed by applying various modification according to knowledge of these skilled in the art without departing from the spirit and scope of this invention.

What is claimed is:

1. A method for producing a high corrosion-resisting sintered body comprising steps of:

TABLE 2

| Powder No. | Sintering Condition | | Cooling Condition | Sintered Body N (%) | Sintered Body O (%) | Salt Spraying Test (hours) 24 | 48 | 72 | 96 | 200 | 400 | 600 | Remarks |
|---|---|---|---|---|---|---|---|---|---|---|---|---|---|
| 1 | 1200° C. × 1 hr, | 5 Torr $N_2$ | 10° C./min | 0.026 | 0.21 | x | | | | | | | Comparative Example |
| 2 | 1200° C. × 1 hr, | 5 Torr $N_2$ | 10° C./min | 0.025 | 0.26 | x | | | | | | | |
| 3 | 1200° C. × 1 hr, | 5 Torr $N_2$ | 10° C./min | 0.034 | 0.21 | x | | | | | | | |
| 4 | 1200° C. × 1 hr, | 5 Torr $N_2$ | 10° C./min | 0.039 | 0.16 | | x | | | | | | |
| 5 | 1200° C. × 1 hr, | 5 Torr $N_2$ | 10° C./min | 0.051 | 0.24 | | | x | | | | | |
| 6 | 1200° C. × 1 hr, | 5 Torr $N_2$ | 10° C./min | 0.046 | 0.40 | | | | | | | ○ | Inventive Example |
| 7 | 1200° C. × 1 hr, | 90 Torr $N_2$ | 10° C./min | 0.19 | 0.43 | | | x | | | | | Comparative Example |
| 8 | 1200° C. × 1 hr, | 90 Torr $N_2$ | 100° C./min | 0.16 | 0.48 | | | | | x | | | Inventive Example |
| 9 | 1200° C. × 1 hr, | 5 Torr Ar | 10° C./min | 0.005 | 0.36 | | | | | | | ○ | |
| 10 | 1200° C. × 1 hr, | 5 Torr $N_2$ | 10° C./min | 0.050 | 0.31 | | | | | | | ○ | |
| 11 | 1200° C. × 1 hr, | 5 Torr $N_2$ | 10° C./min | 0.13 | 0.62 | | | | x | | | | Comparative Example |
| 12 | 1200° C. × 1 hr, | $H_2$ | 10° C./min | 0.004 | 0.47 | | | | | | | ○ | Inventive Example |
| 13 | 1200° C. × 1 hr, | Ar | 10° C./min | 0.003 | 0.46 | | | | | | | ○ | |
| 14 | 1200° C. × 1 hr, | 5 Torr $N_2$ | 10° C./min | 0.047 | 0.36 | | | | | | | ○ | |
| 15 | 1200° C. × 1 hr, | 5 Torr $N_2$ | 10° C./min | 0.14 | 0.67 | | | | x | | | | Comparative Example |
| 16 | 1200° C. × 1 hr, | 90 Torr $N_2$ | 10° C./min | 0.18 | 0.38 | | x | | | | | | |
| 17 | 1200° C. × 1 hr, | 90 Torr $N_2$ | 100° C./min | 0.13 | 0.35 | | | | | | x | | Inventive Example |
| 18 | 1200° C. × 1 hr, | 5 Torr $N_2$ | 10° C./min | 0.031 | 0.29 | | | | | | | ○ | |
| 19 | 1200° C. × 1 hr, | 5 Torr $N_2$ | 10° C./min | 0.045 | 0.31 | | | | | | | ○ | |
| 20 | 1200° C. × 1 hr, | 5 Torr $N_2$ | 10° C./min | 0.051 | 0.33 | | | | | | | ○ | |
| 21 | 1200° C. × 1 hr, | 5 Torr $N_2$ | 10° C./min | 0.037 | 0.27 | | | | | | | ○ | |
| 22 | 1200° C. × 1 hr, | 200 Torr $N_2$ | 10° C./min | 0.53 | 0.32 | x | | | | | | | Comparative Example |
| 23 | 1200° C. × 1 hr, | 200 Torr $N_2$ | 100° C./min | 0.48 | 0.32 | | | | | x | | | Inventive Example |

x: Rusting
○: Non Rusting

By judging from the results shown in Table 2, it is apparent that the sintered body with excellent corrosion resistance can be obtained by sintering the green compact formed from the Fe-based alloy powder according to this invention in the inert gas such as Ar or $H_2$, or the atmosphere of $N_2$ with the pressure of 1 to 10 torr, or by sintering the aforementioned green compact in the atmosphere of $N_2$ with the pressure of higher than 10 torr and not higher than 200 torr and subsequently cooling the sintered compact under the condition of high cooling rate.

compacting Fe-based alloy powder consisting of homogeneous metal powder or a mixture of heterogeneous metal powders to form green compact, said Fe-based alloy powder consisting by weight percentage of: not more than 0.03% of C; not more than 2% of Si; not more than 0.5% of Mn; from 8 to 28% of Ni; from 15 to 25% of Cr; from 3 to 8% of Mo; and the balance being Fe and incidental impurities; and sintering the green compact in an atmosphere of $N_2$ with pressure of 1 to 10 torr.

2. A method for producing a high corrosion-resisting sintered body comprising steps of:

compacting Fe-based alloy powder consisting of homogeneous metal powder or a mixture of heterogeneous metal powders to form green compact, said Fe-based alloy powder consisting by weight percentage of: not more than 0.03% of C; not more than 2% of Si; not more than 0.5 of Mn; from 8 to 28% of Ni; from 15 to 25% of Cr; from 3 to 8% of Mo; at least one of not more than 5% of Cu, not more than 3% of Sn, not more than 2% of Nb and not more than 2% of Ti; and the balance being Fe and incidental impurities; and sintering the green compact in an atmosphere of N2 with pressure of 1 to 10 torr.

3. A method for producing a high corrosion-resisting sintered body comprising steps of:

compacting Fe-based alloy powder consisting of homogeneous metal powder or a mixture of heterogeneous metal powders to form green compact, said Fe-based alloy powder consisting by weight percentage of: not more than 0.03% of C; not more than 2% of Si; not more than 0.5% of Mn; from 8 to 28% of Ni; from 15 to 25% of Cr; from 3 to 8% of Mo; and the balance being Fe and incidental impurities;

sintering the green compact in an atmosphere of $N_2$ with pressure of higher than 10 torr and not higher than 200 torr; and cooling the sintered compact from 1000° C. to 500° C. at cooling rate of not lower than 50° C./min.

4. A method for producing a high corrosion-resisting sintered body comprising steps of:

compacting Fe-based alloy powder consisting of homogeneous metal powder or a mixture of heterogeneous metal powders to form green compact, said Fe-based alloy powder consisting by weight percentage of: not more an 0.5% of Mn; from 8 to 28% of Ni; from 15 to 25% of Cr; from 3 to 8% of Mo; at least one of not more than 5% of Cu, not more than 3% of Sn, not more than 2% of Nb and not more than 2% of Ti; and the balance being Fe and incidental impurities;

sintering the green compact in an atmosphere of $N_2$ with pressure of higher than 10 torr and not higher than 200 torr; and cooling the sintered compact from 1000° C. to 500° C. at cooling rate of not lower than 50° C./min.

* * * * *

UNITED STATES PATENT AND TRADEMARK OFFICE

CERTIFICATE OF CORRECTION

PATENT NO. : 5,603,072
DATED : February 11, 1997
INVENTOR(S) : TOMIO KOUNO et al It is certified that error appears in the above-indentified patent and that said Letters Patent is hereby corrected as shown below:

In claim 4, at column 10, line 11, after "of:" insert --not more than 0.03% of C; not more than 2% of Si;--.

Signed and Sealed this

Twenty-ninth Day of April, 1997

Bruce Lehman

*Attest:*

BRUCE LEHMAN

*Attesting Officer*

*Commissioner of Patents and Trademarks*